US008449063B2

(12) United States Patent
Yamada et al.

(10) Patent No.: US 8,449,063 B2
(45) **Date of Patent: *May 28, 2013**

(54) LIQUID EJECTING APPARATUS

(75) Inventors: Yoichi Yamada, Shiojiri (JP); Kiyoteru Katsuki, Azumino (JP); Masaru Kobashi, Matsumoto (JP); Daisuke Matsumoto, Matsumoto (JP); Yasunori Koike, Matsumoto (JP); Narihiro Oki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 293 days.

This patent is subject to a terminal disclaimer.

(21) Appl. No.: 12/914,058

(22) Filed: Oct. 28, 2010

(65) Prior Publication Data

US 2011/0102490 A1 May 5, 2011

(30) Foreign Application Priority Data

Oct. 29, 2009 (JP) ..... 2009-249175
Apr. 28, 2010 (JP) ..... 2010-103878

(51) Int. Cl.
*B41J 29/38* (2006.01)

(52) U.S. Cl.
USPC ..... 347/14; 347/20; 347/55

(58) Field of Classification Search
USPC ..... 347/6, 14, 16, 20, 34, 55
See application file for complete search history.

(56) References Cited

U.S. PATENT DOCUMENTS 5,298,926 A 3/1994 Fukushima et al.
6,097,408 A * 8/2000 Fukushima et al. ..... 347/34
6,508,540 B1 * 1/2003 Lean et al. ..... 347/55
2007/0091146 A1 4/2007 Endo et al.
2011/0102490 A1 5/2011 Yamada et al.
2011/0102507 A1 * 5/2011 Yamada et al. ..... 347/37
2011/0102513 A1 * 5/2011 Yamada et al. ..... 347/55

FOREIGN PATENT DOCUMENTS

JP 63239061 A * 10/1988
JP 2003-165230 6/2003
JP 2007-118318 5/2007
JP 2007-118320 5/2007
JP 2007-118321 5/2007
JP 2008-213255 9/2008

OTHER PUBLICATIONS

U.S. Appl. No. 12/914,351, Jul. 18, 2012, Office Action.
U.S. Appl. No. 12/914,351, Oct. 29, 2012, Notice of Allowance.

* cited by examiner

*Primary Examiner* — Julian Huffman
*Assistant Examiner* — Sharon A Polk
(74) *Attorney, Agent, or Firm* — Workman Nydegger

(57) ABSTRACT

In the liquid ejecting apparatus, a potential controller that is capable of switching states between a same potential state where potentials at a predetermined portion at the side of the liquid ejecting unit and a predetermined portion at the side of the ejected medium supporting unit are the same and a potential difference generation state where a potential difference is generated between the predetermined portion at the side of the liquid ejecting unit and the predetermined portion at the side of the ejected medium supporting unit. The potential controller forms the same potential state while the ejected medium is transported by the ejected medium transportation unit, and the potential controller forms the potential difference generation state in at least appropriate period while the ejected medium is not transported by the ejected medium transportation unit.

7 Claims, 10 Drawing Sheets

LIQUID EJECTING APPARATUS

BACKGROUND

1. Technical Field

The present invention relates to a liquid ejecting apparatus represented by a facsimile machine and a printer.

2. Related Art

Hereinafter, an ink jet printer as an example of a liquid ejecting apparatus is described. The ink jet printer has a supporting member (also referred to as platen) at a position opposed to an ink jet recording head. Further, the ink jet printer is configured such that a recording sheet is supported by the supporting member so as to define a distance between the ink jet recording head and the recording sheet.

In recent ink jet printers, size of ink droplets is progressively reduced in order to improve recording quality more preferably. For example, size of ink droplets is reduced to approximately several pl, for example. Therefore, mass of the ink droplets is significantly small and even when ink droplets are discharged from an ink jet recording head onto a recording sheet, some ink droplets do not land on the recording sheet and float as ink mists. This causes various types of problems. In addition, in so-called borderless recording, since ink droplets are also discharged onto regions beyond edges of a recording sheet, the above mist floating is caused more significantly. Note that in the borderless recording, recording is performed in a state where margins are not set on four sides of the recording sheet.

Then, as an existing technique, the following technique has been proposed as disclosed in JP-A-2007-118321 and JP-A-2007-118318. That is, potential differences are set among an ink jet recording head, a recording sheet and a supporting member so as to generate an electric field. Therefore, Coulomb's force is made to act on ink droplets so as to attract the ink droplets to a recording sheet.

Transportation of Recording Sheet

In recent ink jet printers, processing speed is made faster particularly for a business purpose and transportation speed of a sheet is largely increased in comparison with that in the past printers along with the increased processing speed. Further, in a so-called serial type ink jet printer, since head scanning (recording) is executed while a sheet is stopped, the sheet transportation speed is required to be further increased in order to prevent reduction in throughput. Note that in the serial type ink jet printer, recording is performed while an ink jet recording head moves in a direction perpendicular to a sheet transportation direction.

However, it has been found that the following problems arise in connection with such high-speed transportation of a recording sheet. Paper powder generated when a recording sheet is cut adheres to end portions (edges) of the recording sheet. In this case, if potentials among three components of the recording sheet, a supporting member (platen) and an ink jet recording head (hereinafter, integrally referred to as "recording portion constituent components") are not controlled, the paper powder adhered to the recording sheet flies toward and adhere to the ink jet recording head by electric fields generated among the recording portion constituent components. In particular, when the recording sheet is transported at high speed, vibration or impact at the time of the sheet transportation is increased. Accordingly, flight of the paper powder is caused more significantly.

Further, friction charging or separation charging is significantly caused accompanied with friction between recording sheets accommodated in a sheet cassette, slide contact or contact between constituent components on a sheet transportation path (for example, an edge guide, a transportation roller, and the like) and the recording sheet. That is, the recording portion constituent components are significantly charged. As a result, electric fields formed among the recording portion constituent components are intensified, and charging of the paper powder itself is also intensified. This increases Coulomb's force acted on the paper powder so that the paper powder adheres to the ink jet recording head more significantly.

Further, even when the paper powder itself is not charged, if flown paper powder is placed in an electric field, bias of charges is caused in the paper powder due to dielectric polarization or electrostatic induction. Therefore, the paper powder is attracted to the side of the ink jet recording head.

FIG. 10 is a descriptive view for pointing out the problem. In FIG. 10, a reference numeral 160 indicates an ink jet recording head, a nozzle plate 160*a*, a supporting member (platen) 170, and a rib 170*a* formed on the supporting member 170 are illustrated. Further, a reference symbol P indicates a recording sheet, a symbol Pe indicates a sheet end portion, and a symbol d indicates paper powder. In addition, "+" and "−" each of which is surrounded by a circle indicate charging polarities.

The recording sheet P is electrically neutralized with a neutralization blush or the like. Therefore, the paper powder d adhered to the recording sheet P is not charged. However, when the nozzle plate 160*a* is positively charged and the supporting member 170 is negatively charged (as an example), charges are generated in the paper powder d as follows. That is, negative charges are generated in the paper powder d at the side of the nozzle plate and positive charges are generated in the paper powder d at the side of the supporting member due to dielectric polarization or electrostatic induction, as shown in an enlarged paper powder d in a circle. Note that the dielectric polarization is caused in a case where the paper powder d has a dielectric property and the electrostatic induction is caused in a case where the paper powder d has a conductive property. Therefore, the paper powder d is attracted to both the sides of the nozzle plate 160*a* and the supporting member 170.

If the paper powder adheres to the ink jet recording head, the paper powder directly closes a nozzle opening, or the paper powder moves to the nozzle opening when a nozzle surface is cleaned (wiped). This causes missing dots.

In addition to the above problem that the paper powder physically closes a nozzle opening, the following problem may be caused. That is, loading filler such as calcium carbonate forming the paper powder react with water content of ink so as to increase viscosity. Therefore, the loading materials inhibit vibration of meniscus of the nozzle opening and interfere with discharging of ink droplets in some case. Accordingly, it is extremely important to prevent the paper powder from adhering to an ink jet recording head in order to obtain appropriate recording quality in an ink jet printer.

In the above JP-A-2007-118321 and JP-A-2007-118318, the following technique has been proposed as described above. In the technique, potential differences are set among the ink jet recording head, the recording sheet, and the supporting member (recording portion constituent components) to generate electric fields. Then, Coulomb's force is made to act on ink droplets so as to attract the ink droplets to the recording sheet. Accordingly, it is considered that paper powder is attracted to the side of the recording sheet by controlling an electric field so as to prevent the paper powder from adhering to the ink jet recording head, if the paper powder is treated as the same triboelectric series as the ink droplets.

However, cellulose fibers and loading materials forming the paper powder are positively or negatively charged easily in terms of triboelectric series. Accordingly, if paper powder is tried to be prevented from flying toward the side of the ink jet recording head by forming an electric field in a specific direction among the recording portion constituent components, paper powder charged in an opposite polarity cannot be prevented from flying to the side of the ink jet recording head.

In JP-A-2003-165230, a recording apparatus having the following configuration is described. In the configuration, in order to prevent paper powder, dusts, or the like from adhering around a nozzle portion of an ink jet recording head as one of purposes, an air duct is provided around a nozzle plate and humidified air is ejected from the air duct at the time of recording and waiting for recording. However, the configuration causes increases in size of the apparatus and cost because the configuration is complex. Further, the configuration may result in an opposite effect of causing a risk that paper powder is made to adhere to the recording head due to airflow.

Further, in JP-A-2008-213255, a technique in which paper powder is collected by a paper powder collection member having a changing property is described. However, in the technique, paper powder cannot be necessarily collected effectively due to the above-described problem relating to the opposite polarity. Further, a problem relating to a method of processing (removing) paper powder deposited on the paper powder collection member arises in the technique. In particular, in a state where a large amount of the paper powder is deposited, there arises a risk that the paper powder scatters around even with little vibration or impact. This causes a problem on long-term maintenance of performance.

SUMMARY

An advantage of some aspects of the invention is to provide a technique of reliably preventing foreign substances such as paper powder and dusts (referred to as "paper powders") from adhering to an ink jet recording head without deteriorating recording quality.

A liquid ejecting apparatus according to a first aspect of the invention includes an ejected medium transportation unit that transports an ejected medium, a liquid ejecting unit that ejects liquid onto the ejected medium while moving in a second direction which is perpendicular to a first direction as a transportation direction of the ejected medium, and an ejected medium supporting unit that is arranged so as to be opposed to the liquid ejecting unit and supports the ejected medium. The liquid ejecting apparatus alternately executes transportation of the ejected medium by the ejected medium transportation unit and liquid ejection by the liquid ejecting unit so as to complete liquid ejection onto the ejected medium. The liquid ejecting apparatus further includes a potential controller that is capable of switching states between a same potential state where potentials at a predetermined portion at the side of the liquid ejecting unit and a predetermined portion at the side of the ejected medium supporting unit are the same and a potential difference generation state where a potential difference is generated between the predetermined portion at the side of the liquid ejecting unit and the predetermined portion at the side of the ejected medium supporting unit. Further, in the liquid ejecting apparatus, the potential controller forms the same potential state while the ejected medium is transported by the ejected medium transportation unit, and the potential controller forms the potential difference generation state in at least appropriate period while the ejected medium is not transported by the ejected medium transportation unit.

According to the aspect of the invention, the potential at the predetermined portion at the side of the liquid ejecting unit and the potential at the predetermined portion at the side of the ejected medium supporting unit are set to be the same while the ejected medium is transported by the ejected medium transportation unit, that is, when paper powders are most likely to scatter from the ejected medium due to vibration or the like. Therefore, an electric field between the liquid ejecting unit and the ejected medium supporting unit is extremely weak or almost no electric field is formed therebetween (hereinafter, such state is referred to as electric field-free state for convenience).

Therefore, the ejected medium to which paper powders adhere is placed on an electric field-free region between the liquid ejecting unit and the ejected medium supporting unit. The paper powders adhered to the ejected medium can be suppressed from scattering and flying. Most of the paper powders are kept adhering to the ejected medium and are discharged to the outside of the apparatus together with the ejected medium. This makes it possible to reliably prevent the paper powders from flying and adhering to the liquid ejecting unit.

Further, the potential controller forms the potential difference generation state (that is, an electric field is formed) for at least appropriate period while the ejected medium is not transported by the ejected medium transportation unit. Therefore, liquid ejected from the liquid ejecting unit can be attracted to the ejected medium or the ejected medium supporting unit, thereby eliminating a problem that the liquid floats as mists.

According to a second aspect of the invention, in the liquid ejecting apparatus according to the first aspect of the invention, the potential controller makes the potential at the ejected medium and the potential at a predetermined portion at the side of the liquid ejecting unit be the same in the same potential state.

According to the aspect of the invention, an electric field-free state is generated between the ejected medium and the liquid ejecting unit. Therefore, the paper powders adhered to the ejected medium can be suppressed from flying toward the liquid ejecting unit more reliably. Most of the paper powders are kept adhering to the ejected medium and are discharged to the outside of the apparatus together with the ejected medium. This makes it possible to prevent the paper powders from adhering to the liquid ejecting unit more reliably.

According to a third aspect of the invention, in the liquid ejecting apparatus according to the first or second aspect of the invention, the potential controller switches the state from the potential difference generation state to the same potential state before the ejected medium is started to be transported by the ejected medium transportation unit.

According to the aspect of the invention, the potential controller switches the state from the potential difference generation state to the same potential state before the ejected medium is started to be transported by the ejected medium transportation unit. Therefore, the electric field-free state can be set reliably at the time where the ejected medium is started to be transported. This makes it possible to prevent the paper powders from flying and adhering to the liquid ejecting unit more reliably.

According to a fourth aspect of the invention, in the liquid ejecting apparatus according to any one of the first aspect to the third aspect of the invention, the potential controller switches from the same potential state to the potential difference generation state after the transportation of the ejected medium by the ejected medium transportation unit is finished.

According to the aspect of the invention, the potential controller switches the states from the same potential state to the potential difference generation state after the transportation of the ejected medium by the ejected medium transportation unit is finished. Therefore, the electric field-free state can be set reliably at the time where the transportation of the ejected medium is finished. This makes it possible to prevent the paper powders from flying and adhering to the liquid ejecting unit more reliably.

According to a fifth aspect of the invention, in the liquid ejecting apparatus according to any one of the first aspect to the fourth aspect of the invention, the potential controller switches the states between the same potential state and the potential difference generation state in end regions of the ejected medium in the second direction which is perpendicular to the first direction as the transportation direction of the ejected medium, and a potential difference is formed between the liquid ejecting unit and the ejected medium supporting unit in a region other than the end regions while the ejected medium is not transported by the ejected medium transportation unit.

According to the aspect of the invention, the ejected medium end portions to which the paper powders significantly adhere are placed in the electric field-free region. Therefore, the paper powders adhered to the ejected medium end portions can be suppressed from scattering and flying. Most of the paper powders are kept adhering to the ejected medium end portions and are discharged to the outside of the apparatus together with the ejected medium. This makes it possible to prevent the paper powders from flying and adhering to the liquid ejecting unit reliably.

A potential difference is formed between the liquid ejecting unit and the ejected medium supporting unit in a region of the ejected medium other than the end regions so that an electric field is formed in the region. The liquid ejected from the liquid ejecting unit is attracted to the side of the ejected medium by Coulomb's force, thereby landing on the ejected medium reliably. Accordingly, the liquid ejection quality can be prevented from deteriorating and a problem caused when the liquid floats as mists can be eliminated.

According to a sixth aspect of the invention, in the liquid ejecting apparatus according to any one of the first aspect to the fifth aspect of the invention, the predetermined portion at the side of the liquid ejecting unit is a surface opposed to the ejected medium supporting unit, and the predetermined portion at the side of the ejected medium supporting unit is a surface opposed to the liquid ejecting unit.

According to the aspect of the invention, predetermined portions having the same potential (portions where potentials are controlled) at the sides of the liquid ejecting unit and the ejected medium supporting unit are surfaces opposed to each other. Therefore, a diffracted electric field from the periphery can be suppressed, thereby reliably placing the paper powders in the electric field-free state.

According to a seventh aspect of the invention, in the liquid ejecting apparatus according to the fifth aspect or the sixth aspect of the invention, regions corresponding to the end regions of the ejected medium on the predetermined portion at the side of the ejected medium supporting unit include a position corresponding to at least one side end portion of the ejected medium in the second direction and extend to the outer side and the inner side of the ejected medium from the position, when the potential controller forms the same potential state, at the side of at least the one side end portion of the ejected medium in the second direction, a line connecting a terminal position which is positioned at the inner side with respect to the end portion of the ejected medium on the region corresponding to the end region of the ejected medium on the predetermined portion at the side of the ejected medium supporting unit and a terminal position which is positioned at the outer side with respect to the end portion of the ejected medium on the predetermined portion of the liquid ejecting unit, is drawn so as to intersect with the ejected medium.

According to the aspect of the invention, a line connecting a terminal position which is positioned at the inner side with respect to the end portion of the ejected medium on the predetermined portion at the side of the ejected medium supporting unit (the region corresponding to the ejected medium end portion in the second direction) and a terminal position which is positioned at the outer side with respect to the end portion of the ejected medium on the predetermined portion of the liquid ejecting unit, is drawn so as to intersect with the end portion of the ejected medium. Therefore, even if an electric field is formed between a region which is positioned at the inner side with respect to the predetermined portion at the side of the ejected medium supporting unit and the liquid ejecting unit, an end portion of the ejected medium is not placed within the electric field (described later in detail).

With the above configuration, the end region of the ejected medium to which the paper powders adhere at the most significant level is reliably placed in a state where an electric field formed between the ejected medium supporting unit and the liquid ejecting unit having the same potential is extremely weak or almost no electric field is formed therebetween (hereinafter, the state is referred to as electric field-free state for convenience). Therefore, the paper powders adhered to the ejected medium end portion can be suppressed from scattering and flying. Most of the paper powders are kept adhering to the ejected medium end portion and are discharged to the outside of the apparatus together with the ejected medium. This makes it possible to prevent the paper powders from flying and adhering to the liquid ejecting unit more reliably.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
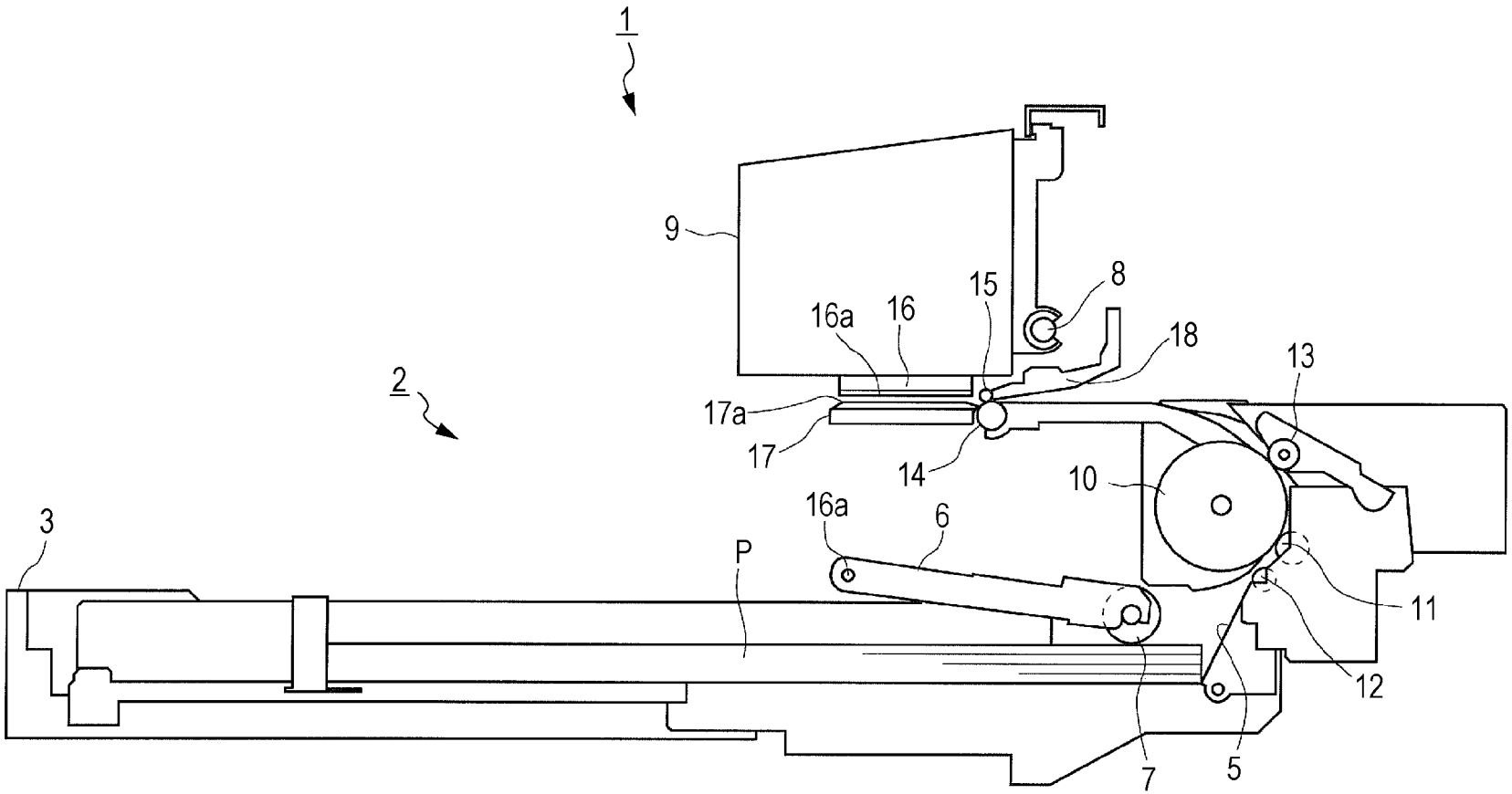
FIG. 1 is a schematic cross-sectional side view illustrating a sheet transportation path of a printer according to the invention.
Figure 2:
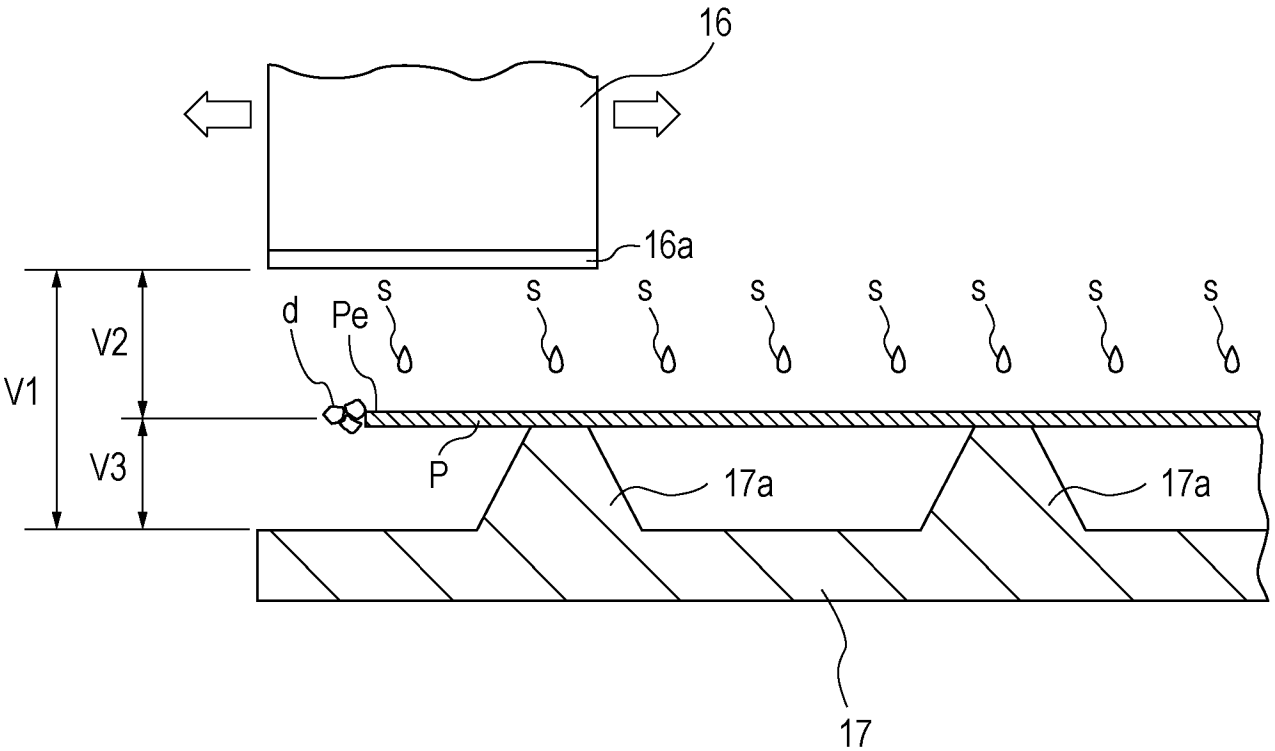
FIG. 2 is a conceptual view for explaining a fundamental idea of the invention.
Figure 3:
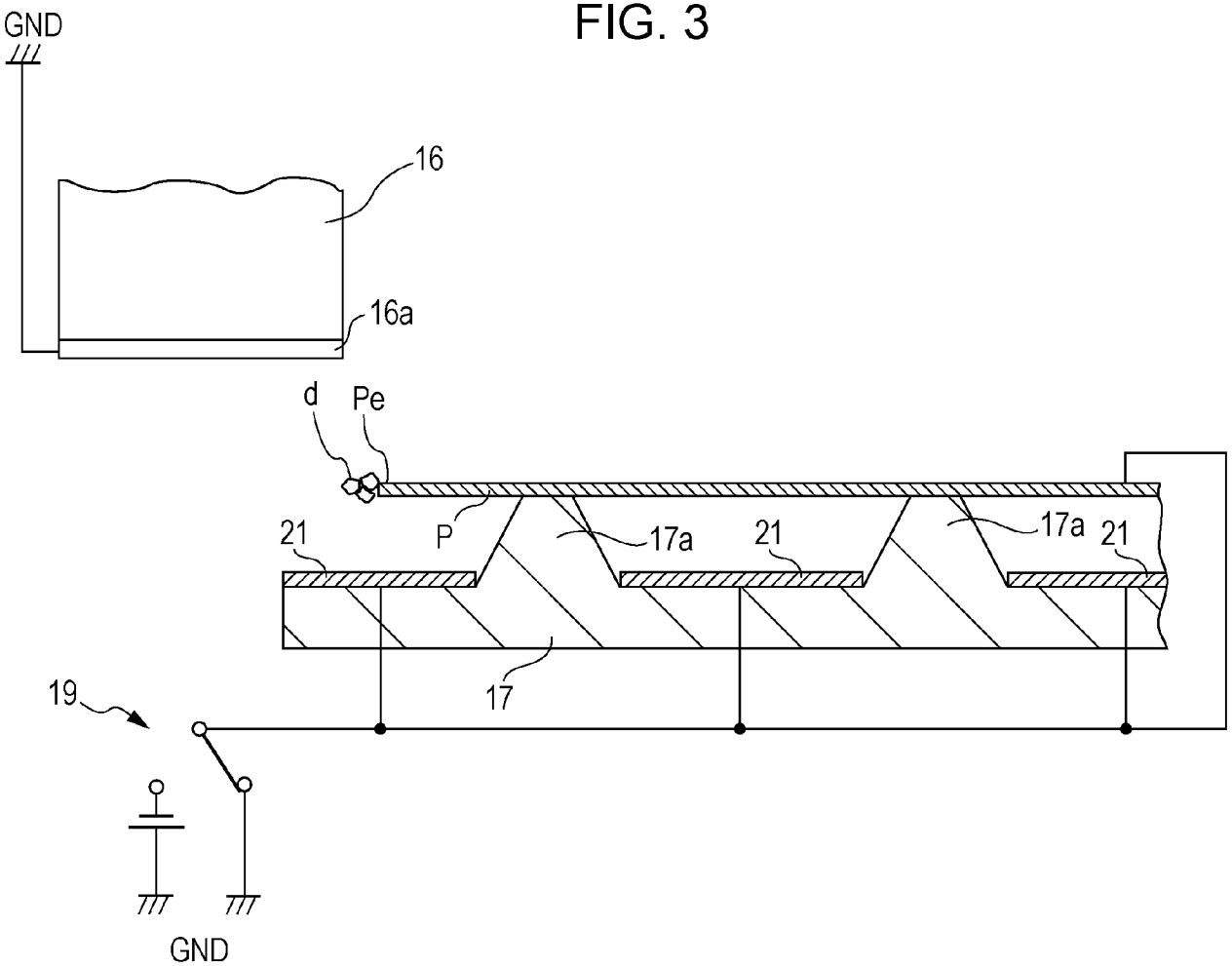
FIG. 3 is a view illustrating a charged state in a recording region of the printer according to the invention (first embodiment).
Figure 4:
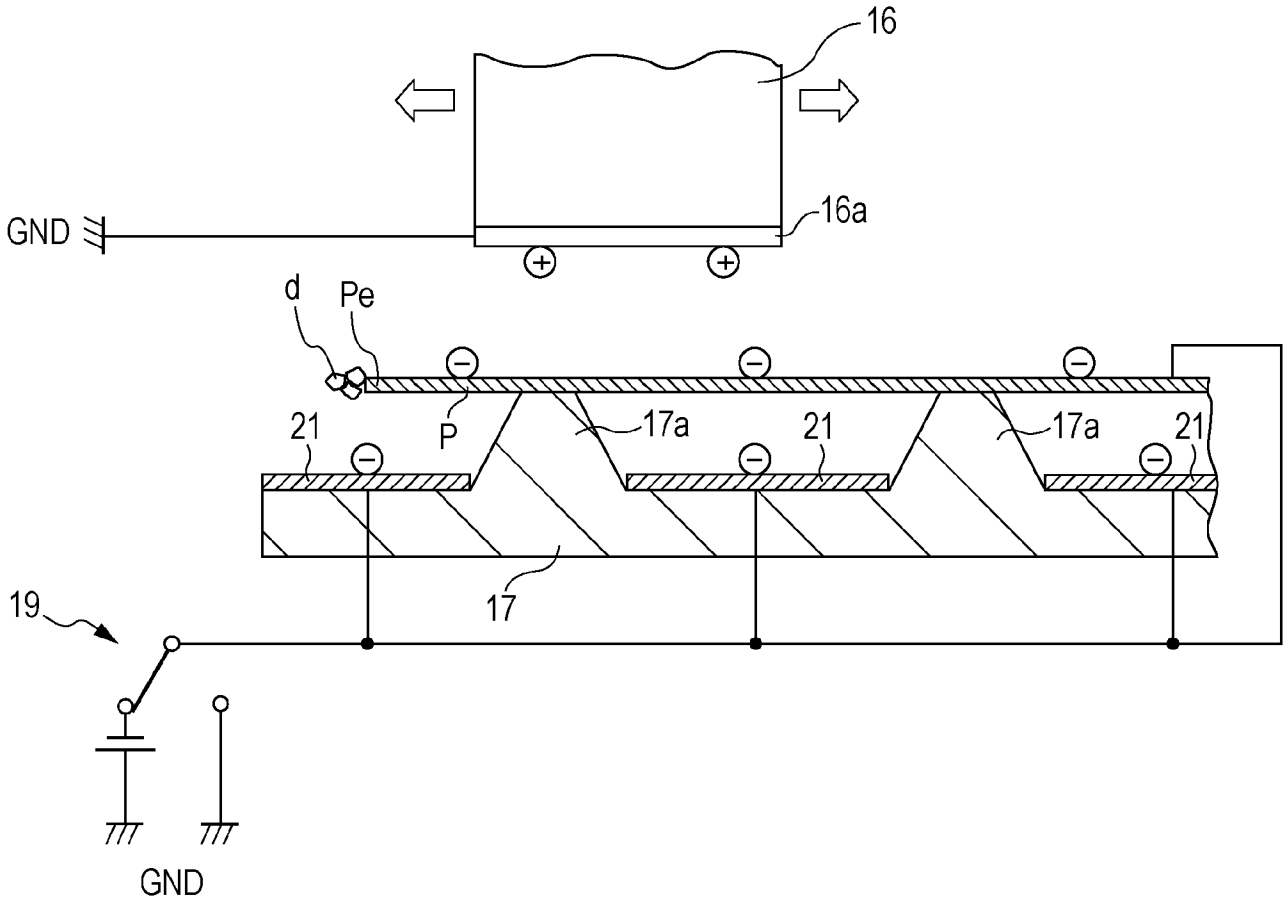
FIG. 4 is a view illustrating a charged state in the recording region of the printer according to the invention (first embodiment).
Figure 5:
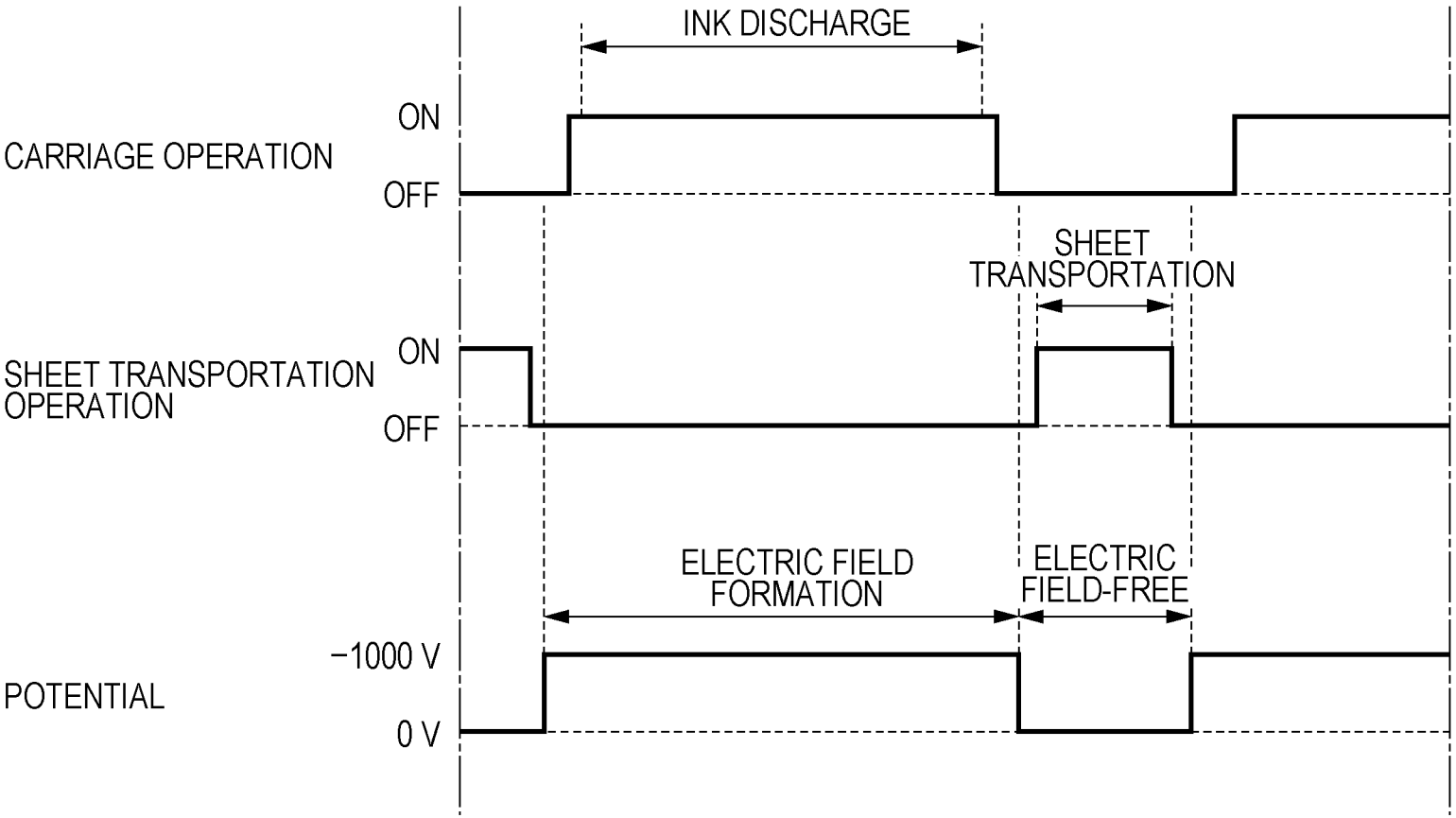
FIG. 5 is a timing chart illustrating a timing at which states of an electric field during recording operation are switched (first embodiment).
Figure 6:
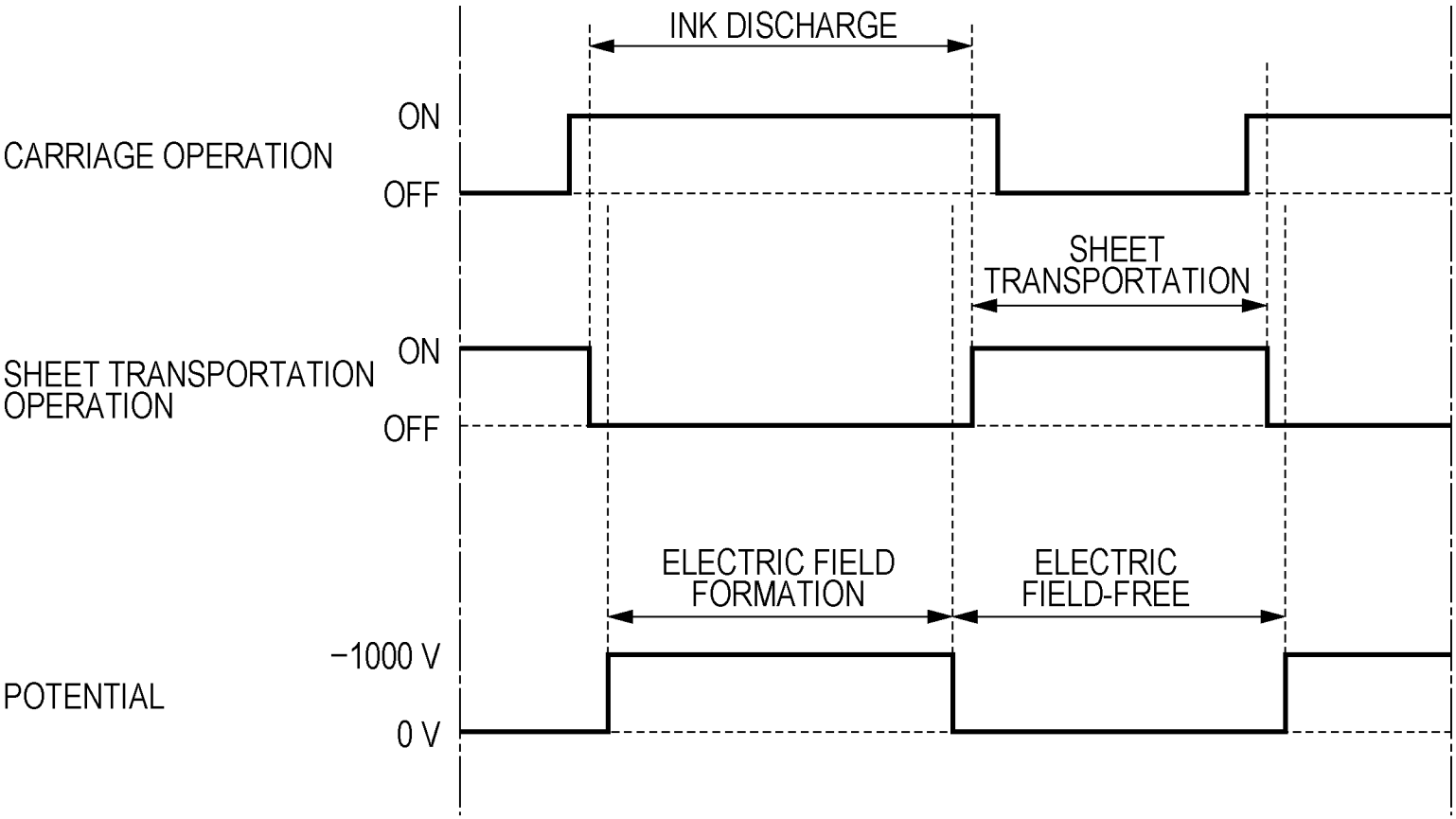
FIG. 6 is a timing chart illustrating a timing at which states of an electric field during recording operation are switched (second embodiment).
Figure 7:
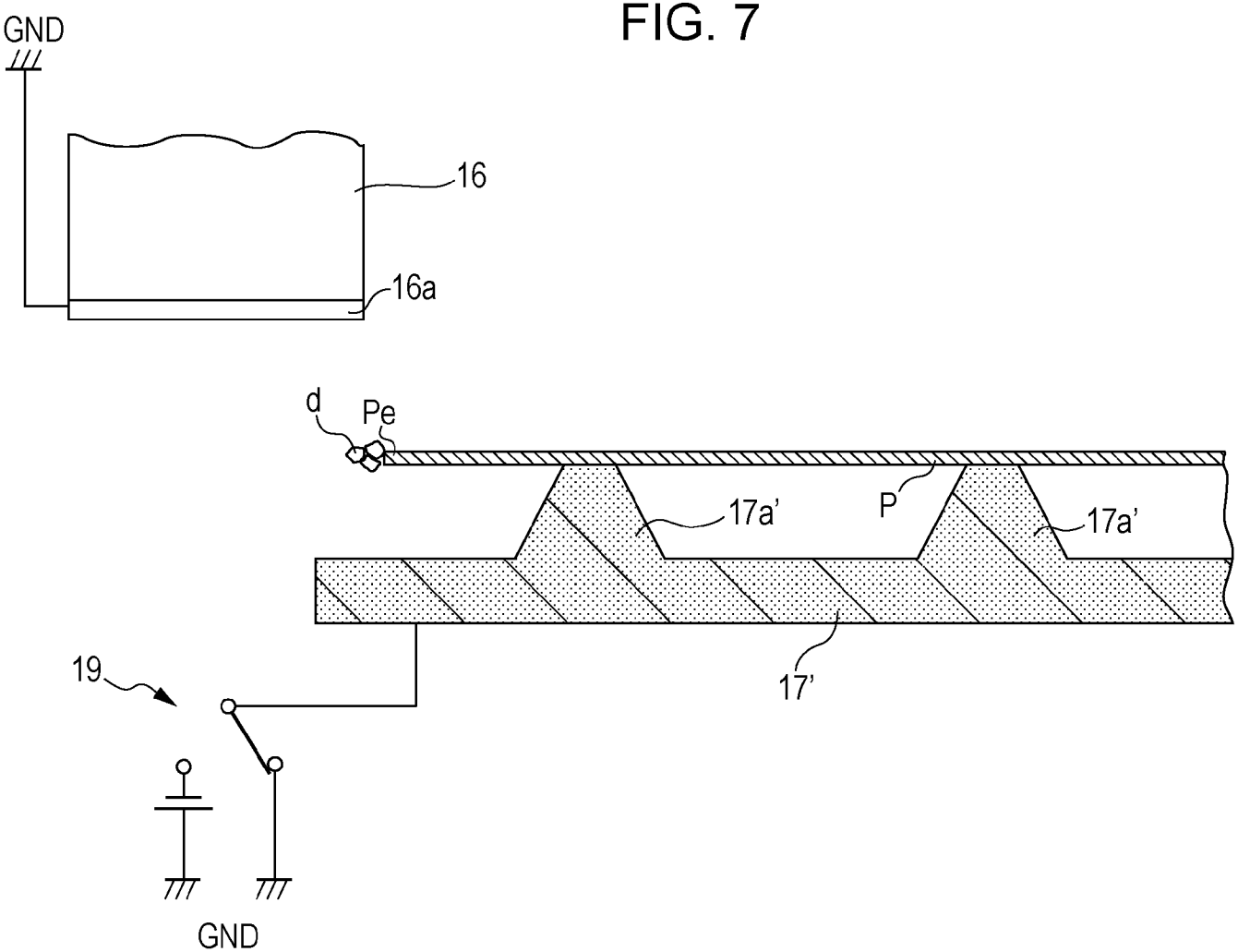
FIG. 7 is a view illustrating a charged state in the recording region of the printer according to the invention (second embodiment).
Figure 8:
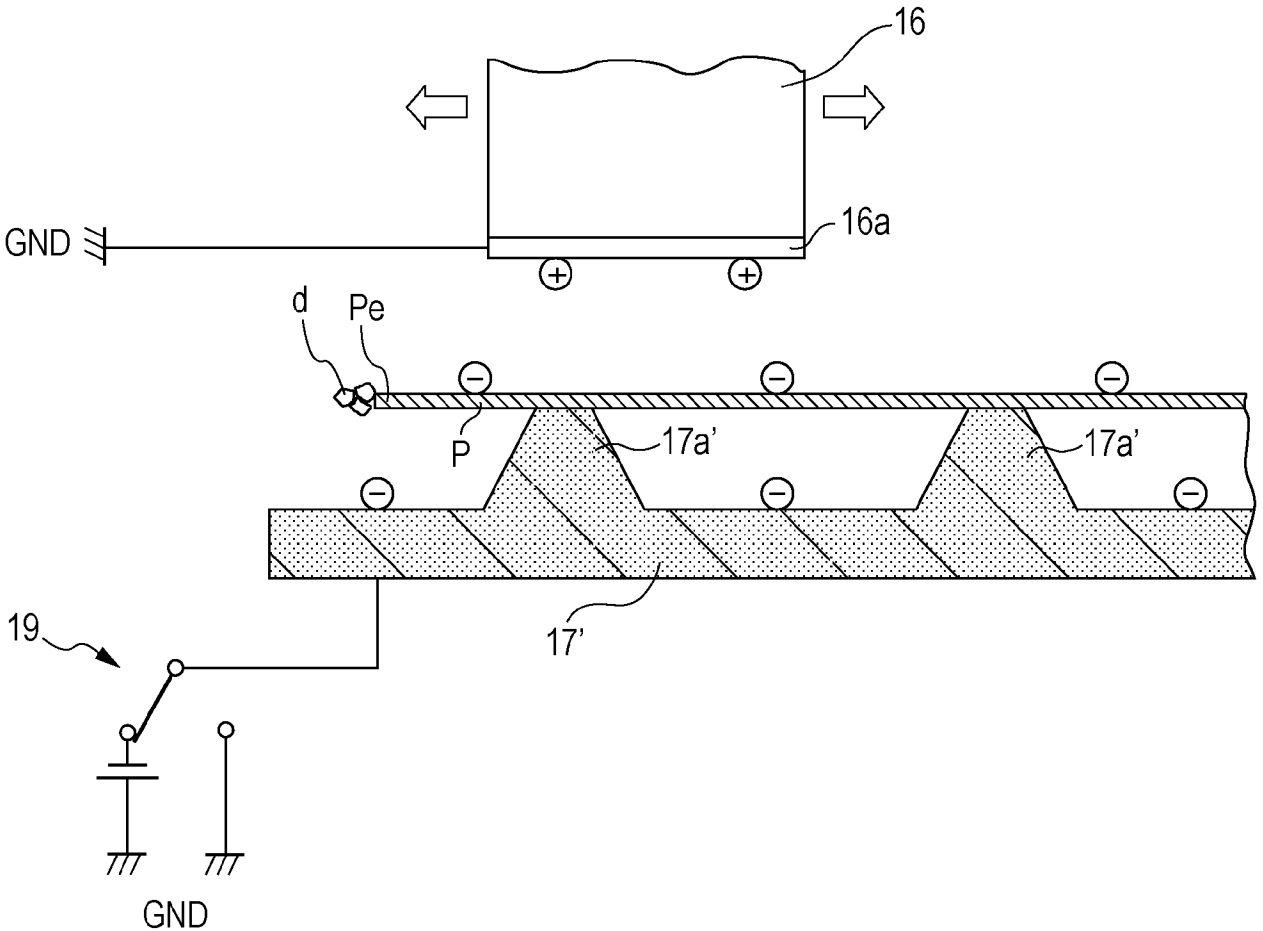
FIG. 8 is a view illustrating a charged state in the recording region of the printer according to the invention (second embodiment).
Figure 9:
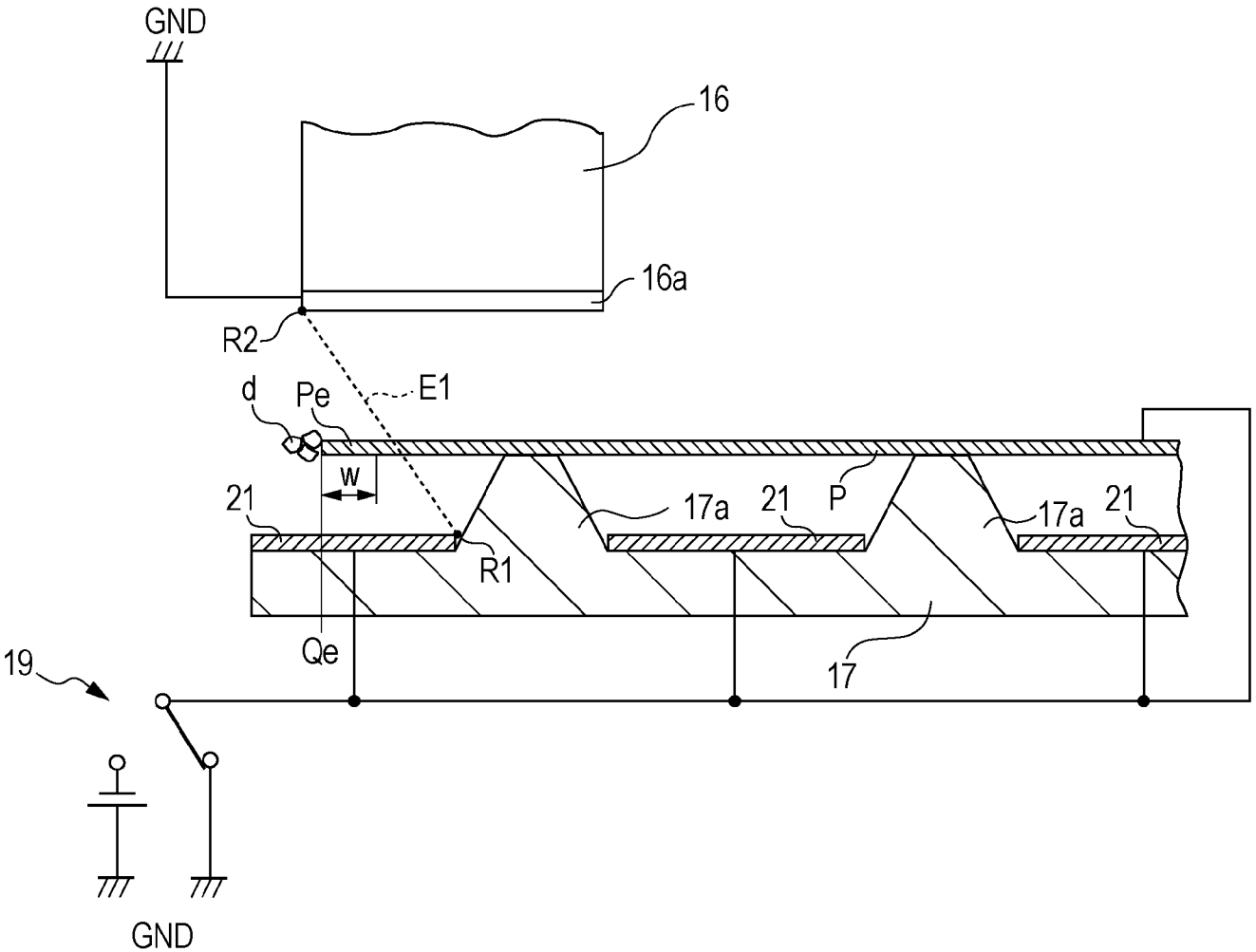
FIG. 9 is a view illustrating a charged state in the recording region of the printer according to the invention (third embodiment).
Figure 10:
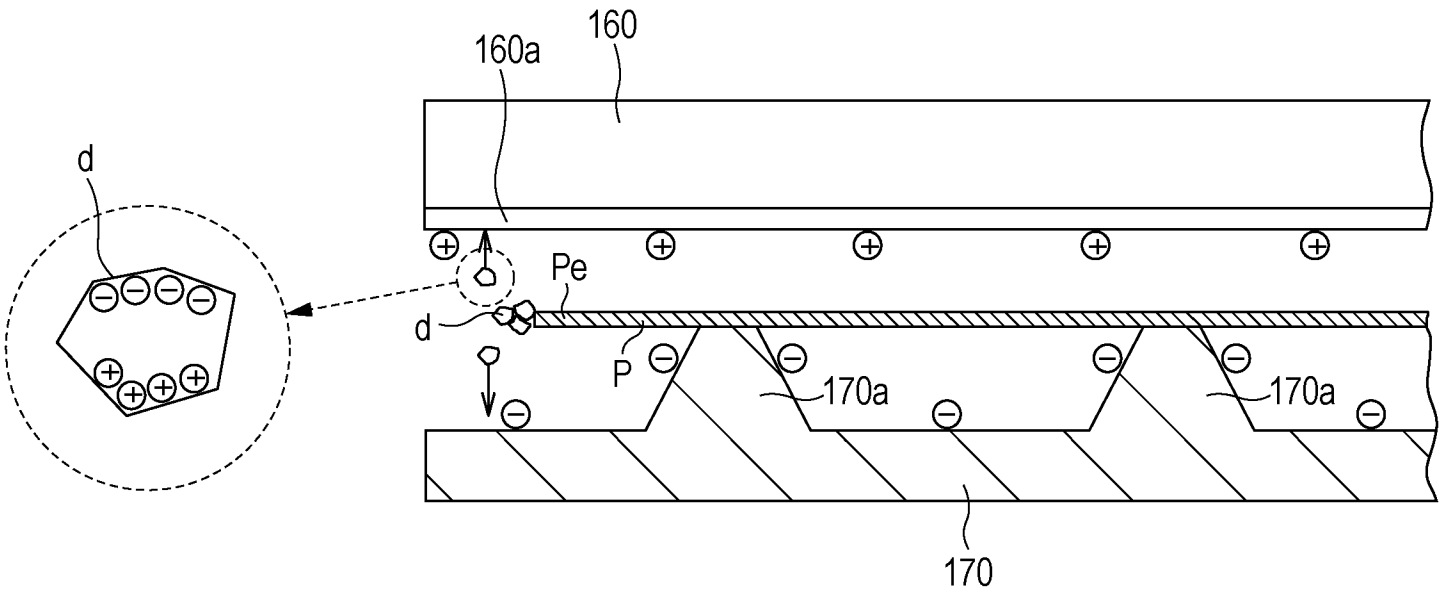
FIG. 10 is a descriptive view for explaining a problem in an existing technique.

Hereinafter, embodiments of the invention are described with reference to drawings. FIG. 1 is a schematic cross-sectional side view illustrating a sheet transportation path of an ink jet printer 1 according to the invention. FIG. 2 is a conceptual view illustrating a fundamental idea of the invention. FIG. 3 and FIG. 4 are views illustrating a charged state in a recording region of the ink jet printer 1 (first embodiment). FIG. 5 is a timing chart illustrating a timing at which states of an electric field during recording operation are switched (first embodiment). FIG. 6 is a timing chart illustrating a timing at which states of an electric field during recording operation are switched (second embodiment). FIG. 7 and FIG. 8 are views illustrating a charged state in the recording region of the ink jet printer 1 (second embodiment). FIG. 9 is a view illustrating a charged state in the recording region (third embodiment). It is to be noted that although one side end region of a sheet P is shown in FIG. 3, FIG. 4, FIG. 7, and FIG. 8, the same configuration is provided on the other side end region thereof. In FIG. 1, a front-to-back direction of a paper plane corresponds to a second direction (sheet width direction) which is perpendicular to a first direction as a sheet transportation direction. In FIG. 2 through FIG. 4 and FIG. 7 through FIG. 9, a horizontal direction in the drawings corresponds to the second direction (sheet width direction) and a front-to-back direction of a paper plane corresponds to the first direction (sheet transportation direction).

Hereinafter, the entire configuration of the ink jet printer 1, which is a common configuration in each embodiment, is schematically described with reference to FIG. 1. The ink jet printer 1 includes a sheet feeding device 2 at a bottom of the ink jet printer 1. Further, the ink jet printer 1 has the following configuration. That is, a recording sheet P as an example of an ejected medium is fed from the sheet feeding device 2, at first. Then, the recording sheet P is curled and reversed on an intermediate roller 10 and fed to the side of an ink jet recording head 16 as a liquid ejecting unit so as to perform recording.

To be more specific, the sheet feeding device 2 includes a sheet cassette 3, a pickup roller 7, the intermediate roller 10, a retard roller 11, and guide rollers 12, 13. A separating inclined surface 5 is provided at a position opposed to distal ends of the recording sheets P accommodated in the sheet cassette 3 which is detachable to the sheet feeding device 2. The recording sheet P sent by the pickup roller 7 is fed to the downstream side while a distal end of the recording sheet P is made into slide contact with the separating inclined surface 5. Therefore, an uppermost recording sheet P to be fed and subsequent recording sheets P which are nearly to be double-fed along with the uppermost recording sheet P are preliminarily separated.

The pickup roller 7 constituting a sheet feeding unit is axially supported by a swing member 6 and is provided so as to be rotationally driven with a driving force of a driving motor (not shown). The swing member 6 can swing about a swing axis 6*a* in a clockwise direction and a counterclockwise direction in FIG. 1. The pickup roller 7 rotates while being in contact with the uppermost recording sheet P accommodated in the sheet cassette 3 at the time of sheet feeding so as to send the uppermost recording sheet P from the sheet cassette 3.

Next, the recording sheet P sent from the sheet cassette 3 enters into a curling-and-reversing area. In the curling-and-reversing area, the intermediate roller 10, the retard roller 11, and the guide rollers 12, 13 are provided.

The intermediate roller 10 is a roller having a large diameter and is rotationally driven by the driving motor (not shown). The intermediate roller 10 forms an inner side of a curling-and-reversing path on which the recording sheet P is curled and reversed. Then, the intermediate roller 10 rotates in the counterclockwise direction in FIG. 1 so as to transport the recording sheet P to the downstream side while winding up the recording sheet P.

The retard roller 11 is provided so as to be capable of pressure contacting with or spaced from the intermediate roller 10 in a state where a predetermined rotational friction resistance is applied to the retard roller 11. The recording sheet P is nipped between the retard roller 11 and the intermediate roller 10 so that the uppermost recording sheet P to be fed and subsequent recording sheets P which are nearly to be double-fed along with the uppermost recording sheet P are separated.

It is to be noted that a sheet returning lever (not shown) is provided on the sheet feeding path near the retard roller 11 and the subsequent recording sheets P which have been inhibited from being fed by the retard roller 11 are returned to the sheet cassette 3 by the sheet returning lever.

The guide rollers 12, 13 are freely rotatable rollers. The guide roller 13 nips the sheet P together with the intermediate roller 10 so as to support the sheet feeding by the intermediate roller 10.

The configuration of the sheet feeding device 2 has been described above. The ink jet printer including the sheet feeding device 2 further includes a transportation driving roller 14 and a transportation driven roller 15 at the downstream side with respect to the intermediate roller 10. The transportation driving roller 14 is rotationally driven by a driving motor (not shown). The transportation driven roller 15 nips the recording sheet P together with the transportation driving roller 14 and is drivenly rotated accompanied with the transportation of the recording sheet P.

A downstream side region of the transportation driving roller 15 corresponds to a recording region where recording is executed onto the recording sheet P. The ink jet recording head 16 as the liquid ejecting unit and the supporting member 17 as an ejected medium supporting unit are arranged so as to be opposed to each other on the recording region. The supporting member 17 defines a distance between the recording sheet P and the ink jet recording head 16 by supporting the recording sheet P.

The ink jet recording head 16 is mounted on a bottom of a carriage 9. The carriage 9 is configured to reciprocate in the sheet width direction (second direction: front-to-back direction of a paper plane of FIG. 1) by a motor (not shown) while being guided by a carriage guide axis 8 extending in the sheet width direction (second direction). Then, scanning of the ink jet recording head 16 (ink discharging from the ink jet recording head 16 while the carriage 9 moves) and sheet transportation operation by the transportation driving roller 14 and the transportation driven roller 15 are alternately executed repeatedly so that recording onto the recording sheet P is completed.

The recording sheet P on which recording has been executed between the ink jet recording head 16 and the supporting member 17 (on a recording region) is discharged to the outside of the apparatus by a discharging unit (not shown) in FIG. 1.

A schematic configuration of the ink jet printer 1 has been described above and a fundamental idea of the invention is described with reference to FIG. 2, hereinafter. In FIG. 2, a reference numeral 16*a* indicates a nozzle plate made of a metal. The nozzle plate 16*a* forms a first side opposed to the supporting member 17 on the ink jet recording head 16 and a plurality of ink discharge nozzles (not shown) are formed on the nozzle plate 16*a*. Further, a reference numeral 17*a* indicates a rib which is formed on the supporting member 17 and extends in the sheet transportation direction (first direction: front-to-back direction of a paper plane in FIG. 2). A plurality of ribs 17*a* are formed with appropriate intervals in the sheet width direction (second direction: right and left direction in FIG. 2). The recording sheet P is supported by the plurality of ribs 17*a*.

A reference symbol Pe indicates a sheet end portion (end portion in the sheet width direction), and a reference symbol d indicates paper powders adhered to the sheet end portion Pe. Further, a reference symbol s indicates ink droplets discharged onto the recording sheet P from the ink jet recording head 16.

A reference symbol V1 indicates a potential difference between the nozzle plate 16*a* and the supporting member (a surface opposed to the nozzle plate 16*a*). A reference symbol V2 indicates a potential difference between the nozzle plate 16*a* and the recording sheet P. A reference symbol V3 indicates a potential difference between the supporting member 17 (a surface opposed to the recording sheet P) and the recording sheet P.

In the invention, the potential difference V1 is set to be zero (hereinafter, the state is referred to as "same potential state") until the recording onto the recording sheet P is completed from the start of the recording. That is to say, the potential difference V1 is set to be zero while the recording sheet P is transported by the transportation driving roller 14 and the transportation driven roller 15, in other words, when the paper powders d are most likely to scatter from the recording sheet P.

On the other hand, the potential difference V1 is set to a value other than zero (in other words, the potential difference V1 is set to be generated) (hereinafter, the state is referred to as "potential difference generation state") for at least an appropriate period while the recording sheet P is not transported.

That is to say, in the same potential state made while the recording sheet P is transported, an electric field is not formed between the ink jet recording head 16 and the supporting member 17 (electric field-free state is caused). Therefore, the recording sheet P to which the paper powder or the like d has adhered is placed on an electric field-free region. That is, Coulomb's force generated by an electric field between the ink jet recording head 16 and the supporting member 17 does not act on the paper powders d adhered to the recording sheet P. Accordingly, the paper powders d are suppressed from scattering and flying and most of them are kept adhering to the recording sheet P and are discharged to the outside of the apparatus together with the recording sheet P. This makes it possible to reliably prevent the paper powders d from flying and adhering to the ink jet recording head 16.

Further, in the potential difference generation state set while the recording sheet P is not transported, an electric field is formed between the ink jet recording head 16 and the supporting member 17. Therefore, Coulomb's force generated by the electric field acts on ink droplets s (in particular, floating ink droplets as ink mists) ejected from the ink jet recording head 16. Accordingly, the ink droplets s can be attracted to the recording sheet P or the supporting member 17, thereby eliminating a problem caused when the ink droplets float as ink mists.

It is to be noted that in the above same potential state, if the potential difference V2 as well as the potential difference V1 are set to be zero, the recording sheet P is placed on the complete electric field-free region. Therefore, the paper powders d adhered to the recording sheet P can be prevented from flying toward and adhering to the ink jet recording head 16 more reliably.

The fundamental idea of the invention has been described above.

First Embodiment

Hereinafter, a charged state (first embodiment) in a recording region is described with reference to FIG. 3 and FIG. 4. In FIG. 3 and FIG. 4, a reference numeral 19 indicates a potential controller. The potential controller 19 switches states between the same potential state (FIG. 3) and the potential difference generation state (FIG. 4). In the same potential state, the potentials of the nozzle plate 16*a*, the supporting member 17, and the recording sheet P are the same. On the other hand, in the potential difference generation state, potential differences are generated among these components.

To be more specific, electrode plates (for example, SUS plates having width of approximately 20 mm) 21 are provided on surfaces of the supporting member 17 (between the ribs 17*a*) opposed to the nozzle plate 16*a*. The electrode plates 21 are configured to be connected to a power source (for example, a negative terminal of the power source of 1000V) and a ground so as to be switched by a switch. Note that each electrode plate 21 is configured such that a length and an arrangement position thereof are set to cover at least the ink jet recording head 16 in the first direction.

Each electrode plate 21 can be connected to the negative terminal of the power source in the embodiment. However, a configuration in which each electrode plate 21 can be connected to a positive terminal of the power source may be employed. Further, a portion of the potential controller 19, which is in contact with the recording sheet P, can be configured by forming rollers positioned at the upstream side of the recording region with a conductive material, for example. The rollers at upstream side of the recording region include the transportation driving roller 14. Alternatively, the portion of the potential controller 19 can be formed by a conductive blush.

In addition, the nozzle plate 16*a* is connected to the ground. Therefore, the nozzle plate 16*a* is kept at a ground potential all the time.

The potential controller 19 selects the ground connection as shown in FIG. 3 until the recording onto the recording sheet P is completed from the start of the recording, that is, while the recording sheet P is transported by the transportation driving roller 14 and the transportation driven roller 15. Accordingly, potentials of the nozzle plate 16*a*, the supporting member 17, and the recording sheet P are the same (ground potential) to cause the electric field-free states among these components.

Therefore, during the transportation of the recording sheet P where the paper powders d are most likely to scatter, Coulomb's force generated by an electric field does not act on the paper powders d. This makes it possible to reliably prevent the paper powders d from flying and adhering to the ink jet recording head 16.

In contrast, the potential controller 19 selects the power source connection as shown in FIG. 4 while the recording sheet P is not transported. Accordingly, electric fields are formed between the nozzle plate 16*a* and the recording sheet P and between the nozzle plate 16*a* and the supporting member 17.

In FIG. 4, reference symbols "+" and "−" each of which is surrounded by a circle indicate charging polarities (likely in FIG. 8). In an example of FIG. 4, negative charges are generated on the electrode plates 21 and positive charges are generated on the side of the nozzle plate 16*a* due to electrostatic induction. Therefore, ink droplets discharged from the ink jet recording head 16 are positively charged. Accordingly, the ink droplets are attracted to the side of the recording sheet P, thereby eliminating a problem that ink droplets float as ink mists. It is to be noted that in FIG. 4, lines of electric force are not shown so as not to make the drawing complex (likely in FIG. 8).

FIG. 5 illustrates a timing at which states of the potential (electric field) are switched in the carriage operation and the sheet transportation operation. Further, FIG. 5 illustrates a part of the recording operation in which the carriage operation and the sheet transportation operation are alternately executed. Note that ink is not necessarily discharged using all of the time where the carriage operation is executed and ink is not discharged in a part of the time, for example, in an acceleration area, a deceleration area and the like of the carriage 9 in some case.

As shown in FIG. 5, when ink is discharged, the potential difference generation state (electric field formation) is set. Then, before the sheet transportation operation is started, the state is switched to the same potential state (electric field-free state). After the sheet transportation operation is finished, the state is switched to the potential difference generation state (electric field formation). This makes it possible to reliably prevent the paper powders from scattering accompanied with the sheet transportation.

FIG. 5 is an example where the carriage operation and the sheet transportation operation are not overlapped. However, the carriage operation and the sheet transportation operation can be overlapped as shown in FIG. 6. FIG. 6 shows an example for improving throughput by setting the timings of the carriage operation and the sheet transportation operation as follows. That is, before the carriage operation is completed (for example, during deceleration operation before the carriage is stopped), the sheet transportation operation is started. Further, before the sheet transportation operation is completed, the carriage operation is started. However, the sheet transportation operation and the ink discharge operation are not overlapped in this case.

Even in a case where the carriage operation and the transportation operation are overlapped as described above, the potential difference generation state (electric field formation) can be switched to the same potential state (electric field-free) before the sheet transportation operation is started. Further, the same potential state (electric field-free) can be switched to the potential difference generation state (electric field formation) after the sheet transportation operation is completed. This makes it possible to reliably prevent the paper powders from scattering accompanied with the sheet transportation.

Second Embodiment

Hereinafter, a second embodiment of the invention is described with reference to FIG. 7 and FIG. 8. It is to be noted that the same reference numerals denote the constituent components which has been already described and the description thereof is not repeated below (the same is true in another embodiment which will be described below).

The second embodiment is different from the first embodiment described above in the following point. That is, in the second embodiment, since the supporting member (denoted by a reference numeral 17') has conductivity (for example, surface resistivity thereof is approximately 102 to 108Ω/□), the electrode plate 21 and the connection member for connecting the recording sheet P to the potential controller 19 are not provided.

That is, since the supporting member 17' itself is a conductor, the electrode plate 21 is not necessary. This makes it possible to simplify a configuration of the apparatus and reduce cost. As the supporting member 17', a substance obtained by mixing a conductive material such as a metal or a carbon into a resin can be used, for example. It is to be noted that the supporting member 17' may be formed by adhering a conductive material such as a metal or a carbon to a surface of an insulating material after the insulating material being formed.

Further, the recording sheet P is in contact with ribs 17*a'* of the supporting member 17' having conductivity. Therefore, a member dedicated for connecting the recording sheet P to the potential controller 19 is not required to be provided. This makes it possible to make the supporting member 17' and the recording sheet P have the same potential while simplifying the configuration and reducing cost.

Other configurations in the second embodiment are the same as those in the first embodiment. The potential controller 19 selects the ground connection as shown in FIG. 7 until the recording onto the recording sheet P is completed from the start of the recording, that is, while the recording sheet P is transported by the transportation driving roller 14 and the transportation driven roller 15. Therefore, the nozzle plate 16*a*, the supporting member 17, and the recording sheet P have the same potential (ground potential) to generate the electric field-free state among these components.

Therefore, during the transportation of the recording sheet P where the paper powders d are most likely to scatter, Coulomb's force by an electric field does not act on the paper powders d. This makes it possible to reliably prevent the paper powders d from flying and adhering to the ink jet recording head 16.

In contrast, the potential controller 19 selects the power source connection as shown in FIG. 8 while the recording sheet P is not transported. Accordingly, electric fields are formed between the nozzle plate 16*a* and the recording sheet P and between the nozzle plate 16*a* and the supporting member 17. Therefore, if ink mists float, the ink mists are attracted to the side of the supporting member 17' so as to collect the floating ink mists.

Other Variations

1. Potential Controller

In each of the above embodiments, when the nozzle plate 16*a*, the recording sheet P, and the supporting member 17 are made to have the same potential (when the electric field-free state is formed), the nozzle plate 16*a*, the recording sheet P, and the supporting member 17 are connected to the ground. However, the electric field-free state can be formed as long as the nozzle plate 16*a*, the recording sheet P, and the supporting member 17 have the same potential. Therefore, the nozzle plate 16*a*, the recording sheet P, and the supporting member 17 are not limited to be connected to the ground and an arbitrary voltage having an arbitrary polarity may be applied thereto.

In each of the above embodiments, while the recording sheet P is transported, the nozzle plate 16*a*, the recording sheet P, and the supporting member 17 have the same potential. However, a configuration where only the nozzle plate 16*a* and the supporting member 17 have the same potential and the potential of the recording sheet P is not controlled (floating) may be employed. With the configuration, a predetermined effect of preventing the paper powders from adhering (effect of preventing the paper powders from adhering to the nozzle plate) can be also obtained.

In FIG. 5 and FIG. 6, a period where the potential controller forms potential differences (electric fields) among the nozzle plate 16*a*, the recording sheet P, and the supporting member 17 corresponds to a period where the recording sheet P is not transported as described above. The electric field formation period may be at least appropriate period as long as the recording sheet P is not transported in the period. In other words, the electric field may be formed by using all of the time in a period where the recording sheet P is transported, or may be formed by using a part of the time in the period. Further, the electric field may be formed by using periods before and after the recording.

2. Ink Jet Recording Head

In each of the above embodiments, a water-repellent film can be provided on a surface of the nozzle plate 16*a*. If a water-repellent film having conductivity is used, the water-repellent film can be suppressed from being charged and the paper powders can be prevented from adhering to the nozzle plate 16*a* while reliably controlling a potential at the side of the nozzle plate.

Further, if a water-repellent film having insulation property is used, an mirror image effect of the nozzle plate 16*a* formed with a metal such as SUS can be reduced and the paper powders floating near the nozzle plate can be prevented from being attracted to the nozzle plate 16*a*. Note that the mirror image effect causes a phenomenon in which if paper powders having charges approach to the nozzle plate, charges opposite to the above a charge is generated at the side of the nozzle plate and the both charges are attracted each other.

It is preferable that a position of the ink jet recording head 16 where a potential is applied (controlled) be a position which is the nearest to the supporting member 17. That is, the position where a potential is applied (controlled) is preferably the nozzle plate 16*a*. To be more specific, it is preferable that the position be a nozzle surface which is a surface opposed to the supporting member 17. Therefore, a potential of the nozzle surface which is the closest to the recording sheet P is controlled. Therefore, a diffracted electric field from the periphery can be suppressed while effectively preventing the paper powders from adhering to the nozzle surface. It is to be noted that the same is true at the side of the supporting member 17 and a predetermined portion of the supporting member 17 where a potential is controlled is preferably a surface opposed to the nozzle plate 16*a*. Further, the reliability of the ink jet recording head 16 can be improved with the configuration in which the potential at the side of the ink jet recording head 16 is not switched and the potentials at the sides of the supporting member 17 and the recording sheet P are switched as in each of the above embodiments.

3. Electrode Plate

In each of the above embodiments, an ink absorbing material (not shown) can be provided on an upper surface of the electrode plates 21 (first embodiment), or between the ribs 17*a*' of the supporting member 17' (second embodiment). Even if ink droplets are discharged to a region beyond the recording sheet P (for example, at the time of the flushing where ink is preliminarily discharged or the borderless printing), the ink droplets can be reliably caught by the ink absorbing material, thereby eliminating the problem that ink mists float.

The ink absorbing material can be formed so as to have conductivity such that a surface resistivity thereof has 102 to 108Ω/□(for example, approximately 105Ω/□). To be more specific, a substance obtained by mixing a conductive material such as a metal, or a carbon into a resin such as polyethylene, polyurethane and is foamed, or a substance obtained by adhering or plating a conductive material such as a metal or a carbon to a resin foam material such as polyethylene or polyurethane can be used as the ink absorbing material. Further, a substance obtained by impregnating a resin foam material such as polyethylene and polyurethane with an electrolyte solution can be used. If the ink absorbing material has conductivity in such a manner, a potential at the uppermost surface of the ink absorbing material (uppermost surface at the side of the nozzle plate) can be reliably controlled. Further, such a conductive ink absorbing material can be used in place of the electrode plate 21.

Further, in the above first embodiment, the electrode plates 21 are provided between the ribs 17*a* in the sheet width direction. However, the electrode plates 21 may be provided on only a sheet end region in the sheet width direction, that is, on only a region to which the paper powders adhere at the most significant level. For example, only the electrode plate 21 at the leftmost side in FIG. 3 may be provided. In this case, the electrode plate 21 may be provided at only a position corresponding to an end portion of the recording sheet of a certain size (for example, A4 size). In addition, the electrode plates 21 may be provided at regions corresponding to end portions of the recording sheets of a plurality of sizes available for the recording sheets in the plurality of sizes. Further, the width of the sheet end region to be considered can be appropriately adjusted depending on the condition that the paper powders d adhere. For example, the width can be set to approximately 2 mm from the sheet end portion to which the paper powders d adhere at the most significant level in the inner side direction. Alternatively, the width can be set to be in a range where a slight margin is provided to the above width (for example, a region from the sheet end portion to a position distanced away from the sheet end portion in the inner side direction by 2 mm to 5 mm). That is to say, the width can be appropriately adjusted depending on the condition that the paper powders d adhere. Further, the electrode plate 21 is configured such that a length and an arrangement position thereof are set to cover such a sheet end region.

4. Grounding Method of Recording Sheet

In each of the above embodiments, the recording sheet P is connected to the ground with various methods. For example, a method in which a conductive blush connected to the ground can be arranged at an arbitrary position so as to be made into contact with the recording sheet P can be employed. Further, the recording sheet P can be connected to the ground through each roller arranged on the sheet transportation path.

5. Application of Charge to Ink Droplets

In the above embodiments, ink droplets are charged by induction charge through the nozzle plate 16*a*. However, charges may be applied to the ink droplets at an arbitrary position on the ink flow path from an ink accommodating chamber (for example, ink cartridge or the like) which accommodates ink to the nozzle plate 16*a*. For example, a configuration in which a part or the entire of inner walls of the ink accommodating chamber is formed with a conductive member and charges may be applied to ink through the inner wall may be employed.

An electric field between the ink jet recording head 16 and the supporting member 17 (or the recording sheet) can be made extremely weak by applying the same potential as that at the side of the supporting member 17 (or recording sheet) to ink as liquid. Therefore, a measure for preventing the paper powders from adhering to the nozzle plate 16*a* can be established. That is, the nozzle plate 16*a* is not limited to a conductive material such as a metal and can be formed with a dielectric material such as silicon, acryl and polyimide. In this case, if the potential of ink in the head is not controlled, an electric field generated by the potential difference between the ink in the head and the supporting member 17 strongly affects the paper powders and the paper powders fly to the side of the nozzle plate 16*a* in some case. However, such a problem can be eliminated by applying the same potential as that at the side of the supporting member 17 to the ink in the head.

Further, when the nozzle plate 16*a* is formed with a dielectric material, the following configuration can be employed as a configuration of applying a potential to the ink in the head. That is, only a portion corresponding to the ink flow path (portion which is in contact with ink) on the nozzle plate is formed with a conductive material and the potential is applied to the ink through the conductive material. For example, when the nozzle plate has a laminate structure, portions corresponding to the ink flow path in all of the layers or at least one layer may be formed with a conductive material.

6. Configuration in Consideration of Electric Field Formed by Regions of Supporting Member Other than Regions where Electrode Plates are Arranged In each of the above embodiments, the configuration in consideration of the electric field formed by regions of supporting member 17 other than regions where the electrode plates are arranged is employed so that the paper powders can be prevented from scattering and flying more reliably. Hereinafter, the configuration is described with reference to FIG. 9. It is to be noted that FIG. 9 illustrates a modification of the first embodiment as shown in FIG. 3 and FIG. 4.

In FIG. 9, a point R1 indicates a terminal position of the electrode plate 21, which is positioned at an inner side of the sheet (right side in FIG. 9) with respect to a position Qe corresponding to the sheet end portion. The position Qe is a position on the supporting member 17 when a perpendicular line is drawn from the sheet end portion to the supporting member 17. A point R2 indicates a terminal position of the nozzle plate 16*a*, which is positioned at an outer side of the sheet (left side in FIG. 9) with respect to the position Qe corresponding to the sheet end portion. Further, a line denoted with a reference numeral E1 indicates a line connecting the point R1 and the point R2.

For example, in FIG. 9, an inner side of the sheet with respect to the electrode plate 21 on the supporting member 17 (right side in FIG. 9) is a region formed with a resin material. Therefore, there is a risk that an electric field is formed between the supporting member 17 and the nozzle plate 16*a* in a region which is an inner side of the sheet with respect to the line E1 (right side in FIG. 9). Namely, even when the sheet end region to which the paper powders d adhere is positioned between the electrode plate 21 and the nozzle plate 16*a*, the electric field as described above is generated. Therefore, if the sheet end region is placed in such electric field, there arises a risk that the paper powders d adhered to the sheet end region scatter and fly toward the nozzle plate 16*a*.

However, the sheet end region can be reliably made in the electric field-free state by configuring such that the line E1 is positioned at an inner side of the sheet (right side in FIG. 9) with respect to the sheet end region, that is, such that the line E1 is intersected with the sheet. Therefore, the paper powders d adhered to the sheet end region can be reliably prevented from scattering and flying toward the nozzle plate 16*a*. Note that the configuration as described above can be realized by adjusting the width and the arrangement position of the electrode plate 21 and a stopped position of the ink jet recording head 16 when the recording sheet P is transported by the transportation driving roller 14 and the transportation driven roller 15.

In the embodiment, the line E1 passes through the sheet at the inner side with respect to a region which is inner side from the sheet end portion by a distance w. However, if the line E1 passes through the sheet at the inner side with respect to at least the sheet end portion (edge), the above effect of preventing the paper powders d from scattering at some degree. Further, the distance w may be set to approximately 2 mm where, left side from this point, the paper powders adhere at the most significant level in consideration of the degree that the paper powders d adhere, for example. Alternatively, the distance w may be set to be in a range where a slight margin is added to the above width (for example, w=approximately 2 mm to 5 mm). That is to say, the distance w can be appropriately adjusted depending on the degree that the paper powders d adhere.

In each of the above embodiments, a configuration of the invention is applied to both one side end portion and the other side end portion of the sheet P. However, the invention is not limited to the configuration. It is needless to say that the same operational effect can be obtained in the one side end portion even in a case where the invention is applied to the one side end portion.

What is claimed is:

1. A liquid ejecting apparatus comprising:

an ejected medium transportation unit that transports an ejected medium;

a liquid ejecting unit that ejects liquid onto the ejected medium while moving in a second direction which is perpendicular to a first direction as a transportation direction of the ejected medium;

an ejected medium supporting unit that is arranged so as to be opposed to the liquid ejecting unit and supports the ejected medium; and wherein the liquid ejecting apparatus alternately executes transportation of the ejected medium by the ejected medium transportation unit and liquid ejection by the liquid ejecting unit so as to complete liquid ejection onto the ejected medium, wherein, in the liquid ejecting apparatus, a potential controller is provided that is capable of switching states between a same potential state where potentials at a predetermined portion at the side of the liquid ejecting unit and a predetermined portion at the side of the ejected medium supporting unit are the same and a potential difference generation state where a potential difference is generated between the predetermined portion at the side of the liquid ejecting unit and the predetermined portion at the side of the ejected medium supporting unit, the potential controller forms the same potential state while the ejected medium is transported by the ejected medium transportation unit, and the potential controller forms the potential difference generation state in at least an appropriate period while the ejected medium is not transported by the ejected medium transportation unit.

2. The liquid ejecting apparatus according to claim 1, wherein the potential controller makes the potentials at the ejected medium and the potential at a predetermined portion at the side of the liquid ejecting unit be the same in the same potential state.

3. The liquid ejecting apparatus according to claim 1, wherein the potential controller switches from the potential difference generation state to the same potential state before the ejected medium is started to be transported by the ejected medium transportation unit.

4. The liquid ejecting apparatus according to claim 1, wherein the potential controller switches from the same potential state to the potential difference generation state after the transportation of the ejected medium by the ejected medium transportation unit is finished.

5. The liquid ejecting apparatus according to claim 1, wherein the potential controller switches states between the same potential state and the potential difference generation state in end regions of the ejected medium in the second direction which is perpendicular to the first direction as the transportation direction of the ejected medium, and a potential difference is formed between the liquid ejecting unit and the ejected medium supporting unit in a region other than the end regions while the ejected medium is not transported by the ejected medium transportation unit.

6. The liquid ejecting apparatus according to claim 5, wherein regions corresponding to the end regions of the ejected medium on the predetermined portion at the side of the ejected medium supporting unit include a position corresponding to at least one side end portion of the ejected medium in the second direction and extend to the outer side and the inner side of the ejected medium from the position, when the potential controller forms the same potential state, at the side of at least the one side end portion of the ejected medium in the second direction, a line connecting a terminal position which is positioned at the inner side with respect to the end portion of the ejected medium on the region corresponding to the end region of the ejected medium on the predetermined portion at the side of the ejected medium supporting unit and a terminal position which is positioned at the outer side with respect to the end portion of the ejected medium on the predetermined portion of the liquid ejecting unit, is drawn so as to intersect with the ejected medium.

7. The liquid ejecting apparatus according to claim 1, wherein the predetermined portion at the side of the liquid ejecting unit is a surface opposed to the ejected medium supporting unit, and the predetermined portion at the side of the ejected medium supporting unit is a surface opposed to the liquid ejecting unit.

* * * * *